US006381804B1

(12) United States Patent
Paterson et al.

(10) Patent No.: US 6,381,804 B1
(45) Date of Patent: May 7, 2002

(54) APPARATUS FOR CONDUCTING AIR INTO BAGS OF VACUUM CLEANERS

(75) Inventors: Chris M. Paterson; Dennis Lamb, both of Long Beach, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

(21) Appl. No.: 09/675,472

(22) Filed: Sep. 29, 2000

(51) Int. Cl.[7] ..... A47L 9/10
(52) U.S. Cl. ..... 15/350; 55/374
(58) Field of Search ..... 15/347, 350, 351, 15/352; 55/374, 378

(56) References Cited

U.S. PATENT DOCUMENTS 2,784,800 A * 3/1957 Segesman ..... 15/347 X
3,344,460 A * 10/1967 Nordeen ..... 15/351
3,350,858 A * 11/1967 Verhagen ..... 15/350 X
5,089,038 A * 2/1992 Kopco ..... 55/378 X
5,792,224 A * 8/1998 Fu et al. ..... 15/351 X
5,970,575 A * 10/1999 Lee ..... 15/350 X

* cited by examiner

*Primary Examiner*—Chris K. Moore
(74) *Attorney, Agent, or Firm*—Faegre & Benson LLP

(57) ABSTRACT

Contoured exhaust ducts for transmitting a particulate-laden airstream from a conduit into a vacuum cleaner bag of an upright vacuum cleaner are disclosed. In one embodiment, the airstream is turned by a transitional section of the exhaust duct by about 90 degrees. The interior of the exhaust duct is smoothly contoured through such transition for avoiding the generation of excessive noise and turbulence. The contoured surface of the transitional section prevents heavy objects entrained in the airstream from rebounding back in a direction against the airflow. The cross-sectional area of the exhaust duct may be maintained constant despite a change in cross-sectional shape from the inlet to the outlet thereof.

13 Claims, 5 Drawing Sheets

APPARATUS FOR CONDUCTING AIR INTO BAGS OF VACUUM CLEANERS

TECHNICAL FIELD

The present invention relates to air conduit structures suitable for use with, for example, an upright vacuum cleaner.

BACKGROUND OF THE INVENTION

Vacuum cleaners are common and well-established appliances for commercial and residential floor care. A wide variety of vacuum cleaner configurations are available to suit the needs of a particular application or user, including upright vacuums, canister models, and hand-held models.

Vacuum cleaners, such as upright vacuums, remove dirt from a carpet by creating a suction strong enough to draw the dirt particles and other contaminants from a section of the carpet up into the vacuum cleaner where the dirty-air is passed through a vacuum bag in which the entrained dirt is captured. To increase the efficiency of this process, a base portion of the vacuum cleaner often has a roller brush for agitating dirt from the carpet as it is being vacuumed.

Inside the vacuum cleaner, a conduit transfers the dirty air from the base of the vacuum cleaner to the vacuum bag. The dirty air conduit runs up a handle assembly or, in cases where the dirty air conduit is rigid, the dirty air conduit can itself function as a portion of the handle. At the end of the dirty air conduit opposite the floor there is a duct from which the dirty air exits from the dirty air conduit. The vacuum bag is attached to the dirty air outlet nozzle and receives and filters the dirty air which it receives from the duct.

The vacuum bag has a bag opening that fits closely over the dirty air outlet duct. The vacuum bag is otherwise a completely closed bag that is made from a porous material, such as porous paper, that allows air to flow through it, but which is too fine for most dirt particles to pass through. As dirty air passes through the vacuum bag, the air is forced through the porous material and the dirt is trapped in the bag. The bag thus collects the dirt from the dirty air and, more importantly, from the floor. Because the material of the vacuum bag is often fragile and can get very dusty, the vacuum bag is commonly held within a protective outer bag.

One common vacuum bag design incorporates a reinforced area, known as a collar, surrounding the bag opening. The collar is usually a square or rectangular piece of thin cardboard. To install the vacuum bag, the user holds the collar by one or more edges, and forces the bag opening over the dirty air outlet nozzle. The collar can be designed with an elastic seal extending inward from the circumference of the bag opening to further seal the gap between the dirty air outlet duct and the bag opening.

As shown in FIG. 1, a prior-art upright vacuum cleaner 20 may comprise a head 22, which includes a motor and fan which cooperate to create suction at floor level. Air sucked into the head 22 by the fan is blown into the dirty air conduit 24 that forms a part of the handle 26 of the vacuum cleaner. Upon reaching the end of the dirty air conduit 24, the air stream with its entrained particulates (the dirty air) is directed through the dirty air exhaust duct 28 into a flexible vacuum cleaner bag 30, which is mounted in a generally air-tight manner to the exhaust duct 28.

FIG. 1 also provides an exploded view of a prior-art dirty air exhaust duct 28 docking system 32 for receiving air from a dirty air conduit and diverting it laterally into a vacuum cleaner bag 30. The docking system 32 comprises a yoke 34 which may be mounted about the periphery of the exhaust duct 28. The exhaust duct 28 includes a flange (not shown) about its periphery for retaining the yoke 34 in place.

The yoke 34 is hinged to a bag dock 36 into which the mounting collar 38 of the bag 30 may be inserted. The yoke 34 and bag dock 36 are made of a somewhat rigid plastic material and snap together when they are pivoted relative to one another from the open position (shown in FIG. 1) to a closed position.

A mounting collar 38 is mounted on the vacuum cleaner bag 30. This collar is configured to slide into guides on the bag dock 36. The mounting collar 38 includes a flexible seal 40 which covers a portion of the aperture 42 which extends through the mounting collar 38 and opens into the interior of the bag 30. The collar 38 is made of three layers of cardboard or the like, the middle layer being slidable with respect to the front and back layers. The tab 44 forms a lower portion of the middle layer of the collar 44, and may be pulled downward relative to the collar 38 to slide the middle layer to a position where the aperture 42 is covered. In this position, the particulate material in the vacuum cleaner bag 30 is sealed therein.

When the bag dock 36 is pivoted to its closed position relative to the yoke 34, the aperture 42 and the seal 40 are positioned about the periphery of the exhaust duct 28 in sealing engagement therewith. The exhaust duct 28 is then in communication with the interior of the vacuum cleaner bag.

In prior art upright vacuum cleaners, such as that shown in FIG. 1, the dirty air conduit 24 generally is closed off adjacent to the dirty air exhaust duct 28 to which the vacuum bag is attached. This exhaust duct generally extends at right angles from the upper end of the dirty air conduit a sufficient distance so that the vacuum cleaner bag, and, as applicable, an outer bag made of cloth or the like, can be mounted on it, with the open mouth of the duct exhausting the dirty air into the bag.

While such a vacuum cleaner functions adequately, there remain certain problems with the design. A common complaint relating to this and other vacuum cleaners is that they are very noisy. One component of this noise is believed to be caused by turbulence generated as the rapidly-flowing dirty air reaches the upper, sealed end of the dirty air conduit and flows laterally out the dirty air duct.

Another difficulty of the present design is rebounding of larger, heavier objects, such as coins, after impact with the sealed end of the conduit. Since the sealed end of the dirty air conduit is generally perpendicular to the direction of flow of the air up the conduit, such objects may bounce back down the conduit (against the air flow) only to be blown back into the end of the conduit and rebound again. Eventually, the object may be blown into the bag, ending this cycle of rebounding, but the noise of the impacts of such objects into the sealed end of the conduit can be disconcerting to users of the vacuum cleaner.

The design also results in loss of vacuum cleaner efficiency. The abrupt change in airflow direction and the turbulence generated in the course of such change of direction result in greater backpressure in the conduit, which results in a reduction in cleaning ability of the vacuum cleaner.

SUMMARY OF THE INVENTION

The present invention is directed to a dirty air exhaust duct for a vacuum cleaner. The exhaust duct receives air from a dirty air conduit and directs it into a vacuum cleaner bag. A vacuum cleaner bag may be mounted to the exhaust duct to collect dirt in the dirty air. A deflector may be mounted on the exhaust duct to prevent air exiting the exhaust duct from blowing directly against the opposed inner wall of a bag mounted to the exhaust duct.

DETAILED DESCRIPTION OF THE INVENTION

The present invention is directed to a dirty air exhaust duct for conducting air from a dirty air conduit into the dirt receptacle of an upright vacuum cleaner or the like.

Figure 1:
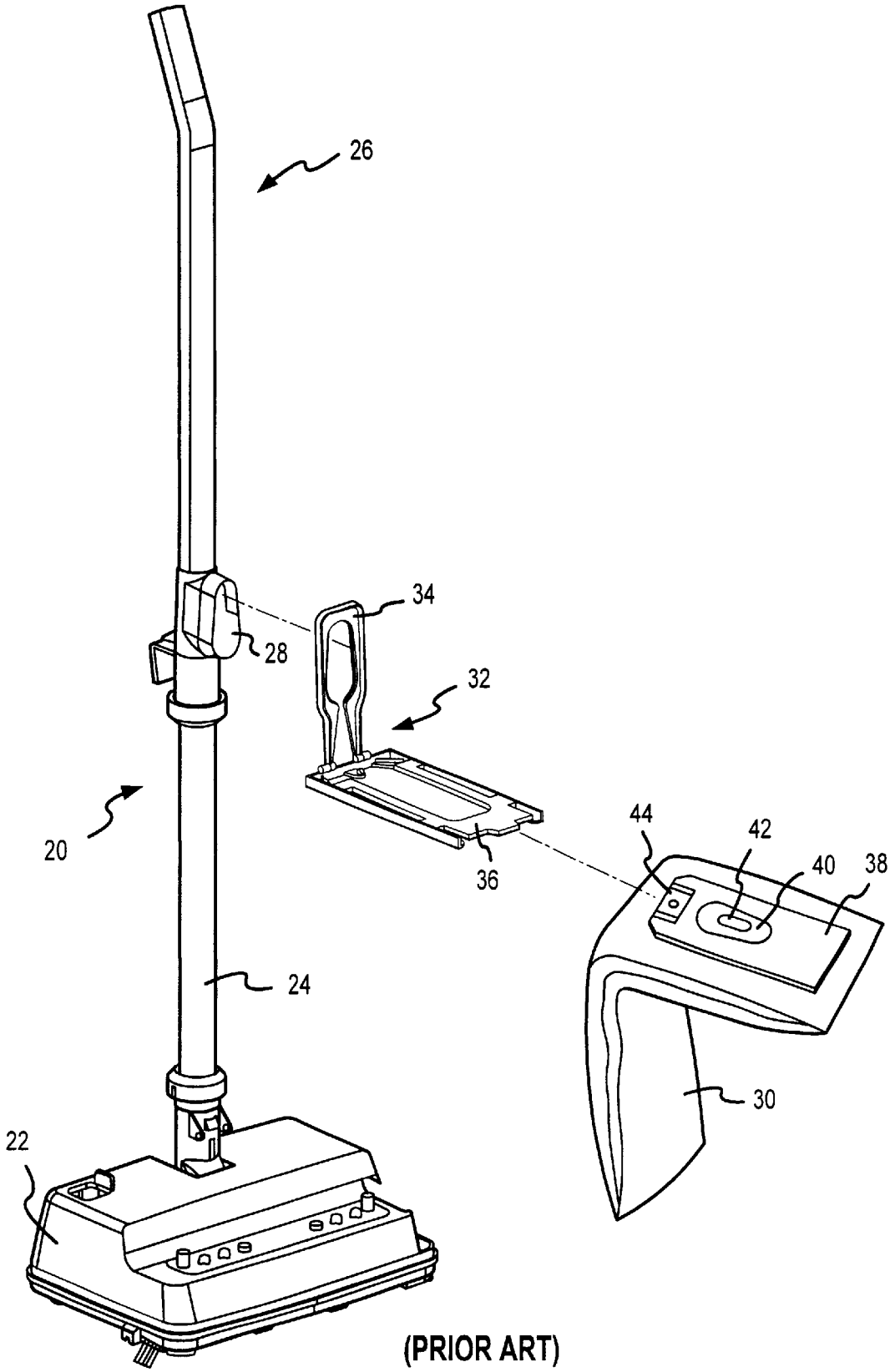
(PRIOR ART) FIG.1
FIG. 1 is a partial exploded view of an upright vacuum cleaner in accordance with the prior art.
Figure 2:
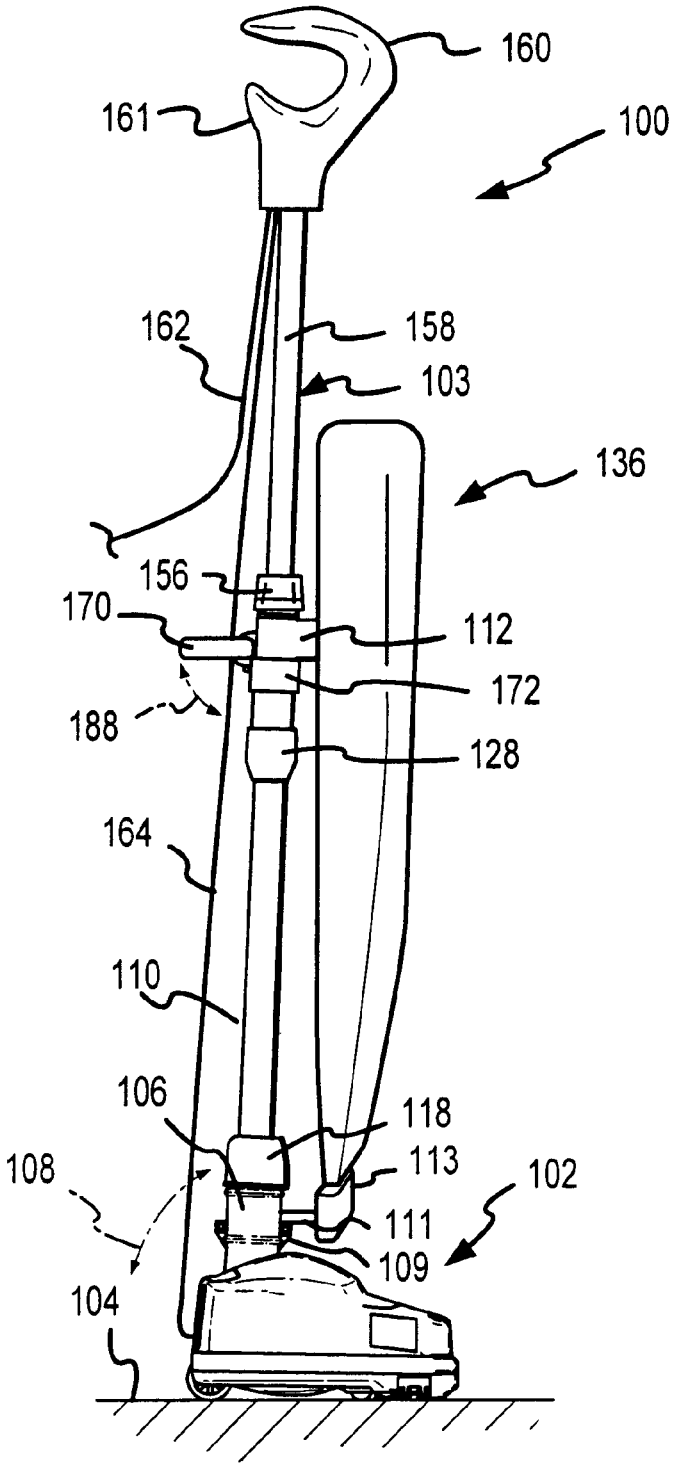
FIG. 2 is a side elevation of an upright vacuum cleaner having a dirty air exhaust duct according to one embodiment of the present invention.

FIG. 2 shows a vacuum cleaner 100 according to one embodiment of the invention. In like manner to the prior art vacuum cleaner 20 of FIG. 1, the present vacuum cleaner 100 includes a head 102 that contains the vacuum motor and fan, a rotary brush, and other such components (not shown) that are known in the art. A handle 103 is pivotably attached to the head for maneuvering and controlling the head.

The purpose of the head 102 and its components is to provide suction at the level of the floor 104, which may be a wood floor, or may be covered with carpet, throw rugs, tile, linoleum or other floor coverings. As is well known, the air entrains particulates such as dirt, sand, lint, crumbs and other food particles, and other materials that may be found on a floor.

The particulate-laden air (dirty air) is exhausted from the head 102 via an exhaust conduit 106, which is pivotably mounted to the head to permit rotation through about 90 degrees from a generally vertical orientation to a generally horizontal orientation as indicated by the arrow 108. The particulate-laden air is transmitted upward along a dirty air conduit 110 to a dirty air exhaust duct 112. The dirty air conduit 110 of the present embodiment may be made of any of a variety of materials, such as steel or aluminum tubing, but should be sufficiently stiff to serve both as a conduit and as a portion of the handle 103 of the vacuum cleaner 100.

A clamp 109 is mounted on the. exhaust conduit 106 of the vacuum cleaner 100 by known means such as screws or other fasteners. A spring clip 111 is mounted on the clamp and is adapted to clip into a slot in the bag clamp 113. The bag clamp 113 is adapted to grip the bottom of a flexible bag case 136, when the two halves thereof are assembled.

Figure 3:
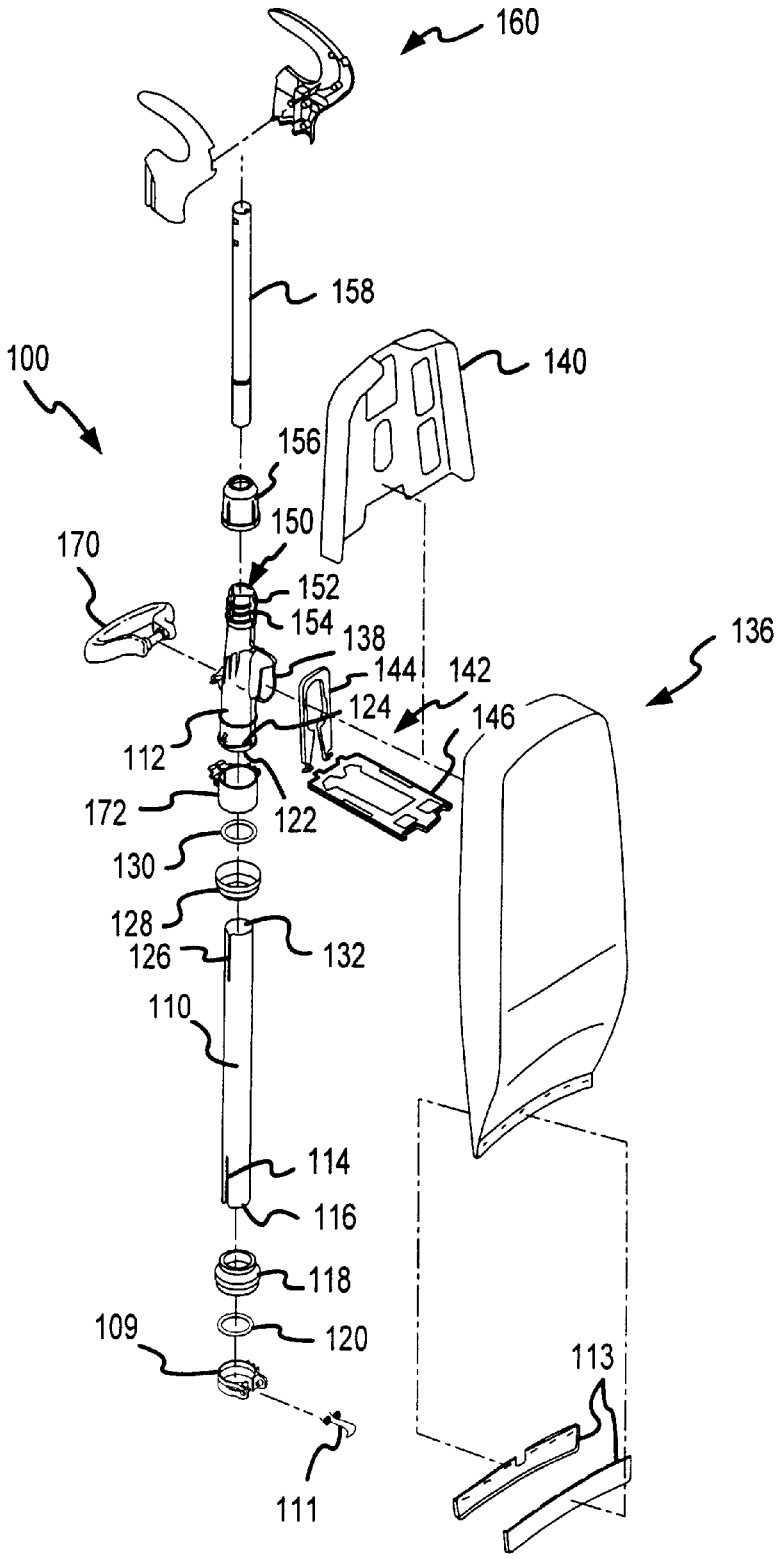
FIG. 3 is an exploded isometric view of the upper portion of the upright vacuum cleaner of FIG. 2.

Referring to FIGS. 2 and 3, in which like elements have like numbering, the dirty air conduit 110 is maintained in engagement with the exhaust conduit 106 as follows. A slot 114 in the lower end of the dirty air conduit 110 is adapted to receive and be substantally filled by a tab (not shown) on the interior wall of the exhaust conduit 106. The tab and slot prevent the exhaust conduit 106 and dirty air conduit 110 from rotating relative to one another.

An annular shoulder may be provided in the exhaust conduit 106 to receive the bottom end 116 of the dirty air conduit 110. Such shoulder preferably has a width approximately equal to that of the wall thickness of the dirty air conduit 110. The dirty air conduit is held in place by a collar 118 and elastomeric ring 120. The collar 118 and ring 120 are adapted to slide onto the dirty air conduit 110 and the collar 118 is configured to receive the ring 120 therein.

The collar 118 threadedly engages the upper end of the exhaust conduit 106 and screws down onto it. The elastomeric ring 120 is thereby compressed between a shoulder internal to the collar 118 and the upper end of the exhaust conduit 106. The compression of the ring forces the ring 120 to expand into tight engagement with the adjacent surface of the dirty air conduit 110, which retains the dirty air conduit 110 against axial movement out of engagement with the exhaust conduit 106 in normal use.

The lower end 122 of the exhaust duct 112 includes a threaded region 124 and can be mounted to the dirty air conduit 110 in like manner to the mounting of the dirty air conduit 110 to the exhaust conduit 106. A tab (not shown) on the interior of the exhaust duct 112 is received in a slot 126 in the upper end of the dirty air conduit 110, substantially filling the slot 126. A collar 128 and elastomeric ring 130 are slid over the upper end 132 of the dirty air conduit 110, and the collar is screwed onto the lower end 122 of the exhaust duct 112, compressing the ring 130 and causing it to frictionally engage the adjacent wall of the dirty air conduit 110. Of course, in another embodiment the dirty air conduit 110 and exhaust duct 112 could be joined in any of a variety of known manners, such as by using clamps, flanges and fasteners or bonding of one to the other. The dirty air conduit 110 and the exhaust duct 112 could also be formed as a single unit if desired.

Figure 4:
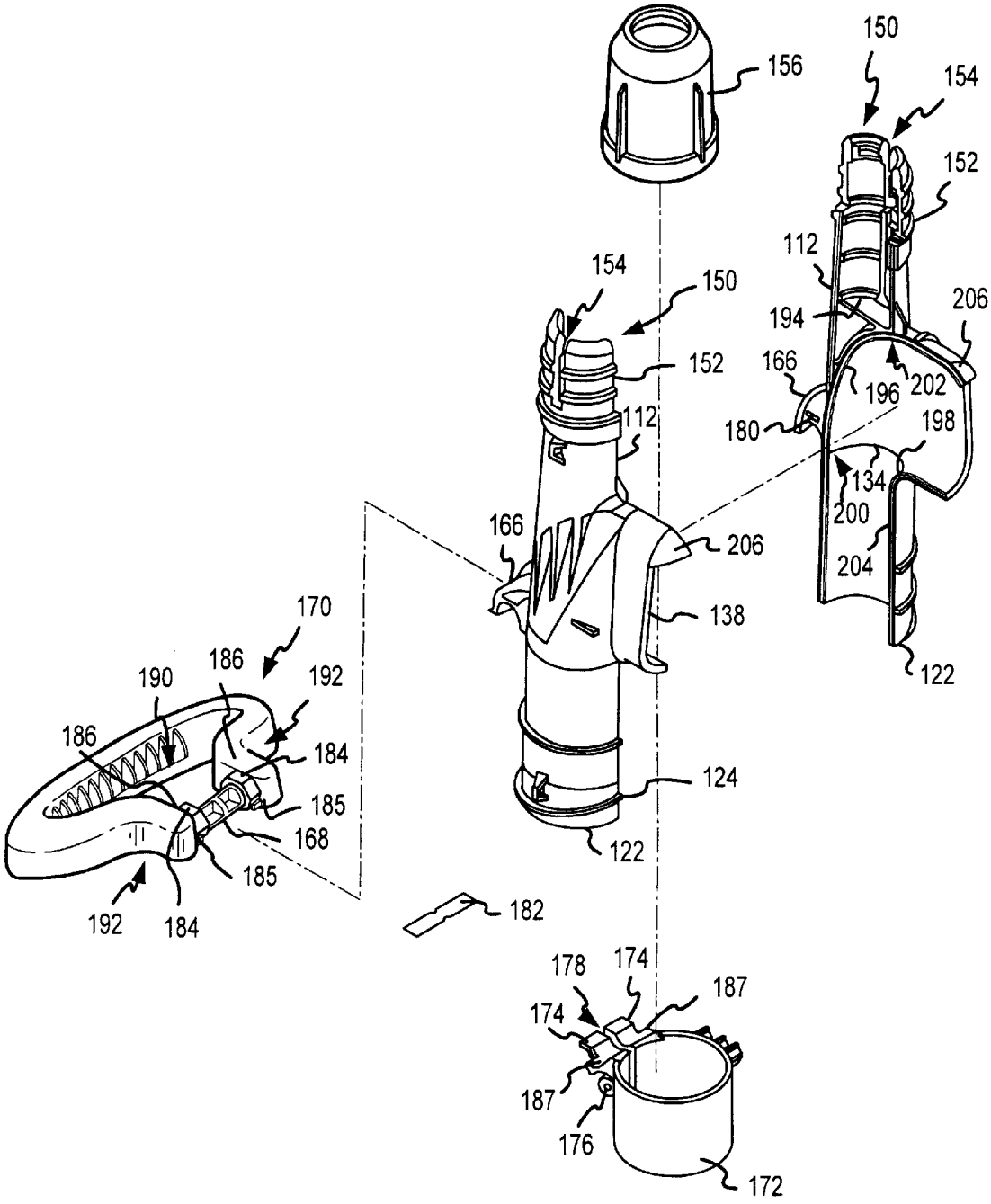
FIG. 4 is an exploded isometric view of a dirty air exhaust duct according to one embodiment of the present invention with associated components.

As best shown in FIGS. 3 and 4, the upper end 132 of the dirty air conduit 110 (FIG. 3) is configured to abut a shoulder 134 (FIG. 4) which extends around the interior surface of the exhaust duct 112. The shoulder may preferably have a width equal to the wall thickness of the dirty air conduit 132 to provide the airflow in the conduit with a smooth transition from the dirty air conduit 110 to the exhaust duct 112 to avoid generation of turbulence at the transition point.

As shown in FIGS. 2 and 3, the vacuum cleaner 100 is provided with a bag case 136 into which the dirty air may be exhausted from the dirty air exhaust duct 112. The bag case 136 may be made of a flexible material that is resistant to wearing and ripping, and that is either air pervious or includes vents to allow the escape of air. In another embodiment, the bag case may be a vented, rigid case made of plastic or other such material. The bag case 136 is adapted to be mounted over the mouth section 138 of the dirty air duct 112. The bag case 136 may be openable with a zipper or other such means, for insertion and removal of vacuum cleaner bags, such as the prior art bag 30, which may be made of a fibrous material such as porous paper. The bag case 136 is adapted to contain the bag without unduly constricting it.

After the bag case 136 has been positioned over the mouth 138 of the duct 112, a bag case support 140 (for flexible bag cases 136) and bag docking system 142 are inserted in the bag and positioned over the mouth 138 of the exhaust duct 112. The yoke 144 engages the periphery of the mouth 138 firmly to maintain the docking system (and the bag case 136 and bag case support 140) in place. A mounting collar of a vacuum cleaner bag (not shown) may be inserted into the bag dock 146, and the bag dock 146 may be pivoted relative to the yoke 144 to position the vacuum cleaner bag in sealing engagement with the mouth 138 of the exhaust duct 112, as described in connection with the prior art vacuum cleaner of FIG. 1. The bag case 136 may then be closed.

The upper end 150 of the exhaust duct 112 includes a threaded section 152. A plurality of vertical slots 154 extend to the upper end of the exhaust duct 112. The threaded section 152 and the slots 154 cooperate with a collar 156 to form a collet-like connector for receiving and gripping an upper handle segment 158.

A two-piece handle (or grip) 160 for permitting a user to grip the end of the handle 103 may be mounted to the upper end of the upper handle section 158 by fasteners such as screws. The two halves of the handle 160 may advantageously be made of a thermoplastic material, and may be bonded together by known methods such as vibratory welding or use of adhesives.

A switch may be provided in the handle 160 for controlling the flow of electricity to the motor in the head 102 of the vacuum cleaner 100. For this purpose, a first power cord 162 adapted to be plugged into a wall outlet may be routed through the handle 160 to the switch, and a second power cord 164 may extend from the switch, through the handle 160 and into the head 102 of the vacuum cleaner 100 to power the vacuum cleaner motor. The lower tip of the handle 161 may be angled upward and outward from the longitudinal axis of the upper handle section 158, which makes it able to retain a plurality of loops of the power cord 162 thereon, as will be explained below. Alternatively, a hook could be mounted on the handle 160 or handle section 158 to receive loops of a power cord 162.

Referring to FIGS. 2, 3 and 4, a handle mount 166 extends from the side of the exhaust duct 112 opposite the mouth 138. The handle mount 166 defines a hemicylindrical channel for receiving a cylindrical portion 168 of the handle 170. A handle support clamp 172 adapted to fit around the exhaust duct 112 below the mouth 138 includes a handle mount 174 which defines a hemicylindrical channel corresponding to that defined by the handle mount 166 of the exhaust duct 112. The clamp 172 is secured in position by a fastener, such as a screw, which extends through an aperture 176 therein. The handle mount 174 is divided into two parts by a slot 178. A screw inserted in the aperture 176 may thus extend through both halves of the handle mount 174. When the screw is tightened (e.g., by screwing it into a nut on the opposite side of the handle mount 174 from that on which the head of the screw is located, by using a thread-forming screw that passes through one of the two halves of the handle mount and anchors itself into the other half), the opposed faces of the slot 178 may be drawn together, drawing the clamp 172 tightly about the exterior of the exhaust duct 112.

The handle mount 174 of the clamp 172 is formed such that, when the clamp 172 is mounted on the exhaust duct 112, it forms a cylindrical channel with the handle mount 166 of the exhaust duct 112 to receive the cylindrical portion 168 of the handle 170.

As best shown in FIG. 4, a slot 180 is provided in the handle mount 166. The slot is configured to receive a leaf spring 182, which bears on a plurality of cam surfaces 184 of the handle 170 when the handle is positioned in the cylindrical channel formed by the handle mounts 166, 174. The shoulders 186 adjacent the cam surfaces 184 prevent the leaf spring from moving out of the channel 180. The leaf spring and cam surfaces 184 cooperate to maintain the handle 170 either in the extended, generally-horizontal position, in which it extends outward from the exhaust duct 112, as shown in FIG. 2, to a retracted, generally vertical position (not shown) in which the handle 170 is pivoted through an angle 188 downward and against the exhaust duct 112.

Stops 185 extend from the cylindrical portion 168 of the handle 170. When the handle is pivoted to its extended position, the stops 185 engage shoulders 187 on the clamp 172, preventing the handle from pivoting upward beyond the generally horizontal position.

As shown in FIG. 4, the handle 170 includes a broad grip section 190, which is sufficiently large to allow an operator to insert his or her hand therein. This broad grip section 190 is attached to the cylindrical portion 168 by a narrow neck section 192. The difference in width between the neck section 192 and grip section 190 is sufficient that the handle, when in its extended position, may receive a plurality of loops of the power cord 162.

The mid-level handle 170 may advantageously be positioned in, and to maintain its position in the extended and retracted positions. First, as the greatest portion of the mass of the vacuum cleaner 100 is concentrated in the head 102, the handle 170 is located above the center of mass of the vacuum cleaner 100. Thus, in the extended position, the handle 170 may be used to carry the vacuum cleaner 100, or may be positioned over a hook on a wall or cart to permit convenient storage or transportation thereof.

The handle 170 is also useful in its extended position when cleaning surfaces that are located above the level at which a user is standing. By gripping the handle 160 in one hand and the handle 170 in the other, a user may conveniently manipulate the vacuum cleaner 100 on stairs above the level at which the user is standing.

Figure 5:
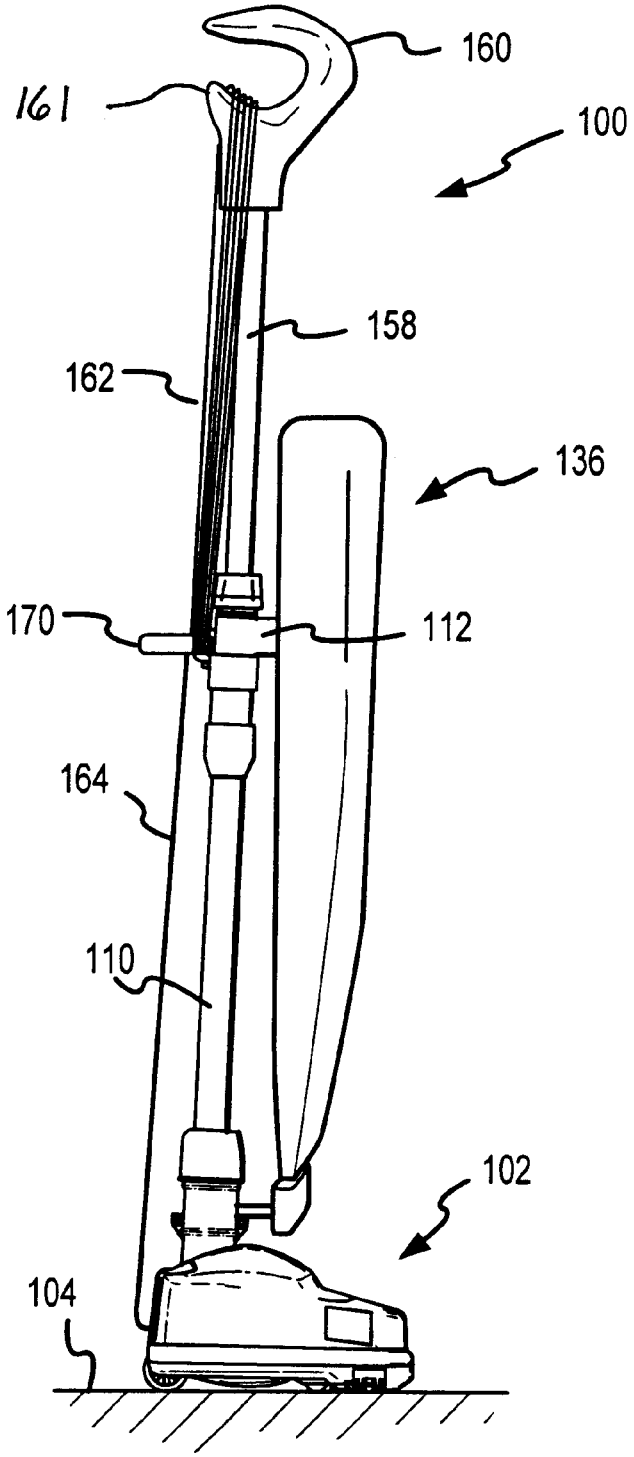
FIG. 5 is a side elevation of a vacuum cleaner according to one embodiment with the power cord stowed on the handles thereof.

Finally, as shown in FIG. 5, multiple loops of the power cord 162 may be wrapped about the neck 192 of the extended handle 170 and around the handle 160 for storage purposes. The broad grip section 190 of the handle 170 prevents the cord 162 from slipping off the handle 170, and the upwardly-oriented tip 161 of the handle 160 likewise retains the loops of cord 162 on the handle 160. Of course, in lieu of wrapping the cord 162 about the handle 160, a hook could be provided at a position adjacent to the handle 160 to receive the cord 162.

The extended position of the handle provides some drawbacks, however. When vacuuming under furniture, the user may wish to pivot the handle 160 relative to the head 102 of the vacuum cleaner through an angle 108 to a position near to the floor 104. Having the handle extending outward from the back of the exhaust duct 112 may impair the ability of the user to lower the handle 170 as far as may be desired. Thus, the ability of the handle 170 of the present embodiment of the invention to be positioned in its retracted position and maintained in that position by the cam spring 182 and cam surfaces 184 will facilitate cleaning in such circumstances.

Similarly, when cleaning behind obstacles, such as low tables, a protruding handle may catch on the obstacles. Again, the ability of the handle 170 to be positioned and maintained in a retracted position may facilitate the cleaning process.

The handle 170 of the present embodiment may advantageously be made of a thermoplastic, thermosetting or other material that has suitable rigidity and strength, and preferably is impact resistant. The handle may be formed by one or more known methods, such as injection molding, casting and machining. Preferably, the injection molding of a thermoplastic material is used. The handle may be molded in multiple pieces that may be bonded together by one or more known methods such as the use of vibratory welding, thermal bonding or solvent or adhesive bonding.

One of the problems of conventional vacuum cleaners that makes their use undesirable is the level of noise they generate. Although this noise is within safety limits for the operator and others who may be nearby, it is still desirable to limit the amount of noise made by vacuum cleaners. This is particularly the case where the vacuum cleaners may be used near others who may be sleeping, who may be ill and in need of rest, or who may have difficulty concentrating or conversing over the noise.

Another problem common to upright vacuum cleaners with dirty air conduits that terminate in an exhaust duct that exhausts the air at approximate right angles to the airflow up the conduit is the problem of rebounding of heavier objects entrained in the airstream as described above. As shown and explained in connection with FIGS. 3 and 4, the exhaust duct 112 according to one embodiment of the present invention addresses both of these problems.

The exhaust duct 112 has an inlet of generally circular cross-section at its lower end 122. The mouth 138 of the exhaust duct 112, by contrast, has a generally-oval shape. While prior art devices have tended to simply provide a wall such as the wall 194 across the duct to stop further airflow therealong, and provide an outlet of any desired configuration, such exhaust ducts may create turbulence that increases the noise level of the vacuum cleaner and allows for rebounding of heavier objects. The increased turbulence also increases the backpressure in the vacuum cleaner, reducing the suction power thereof.

In the device of the present embodiment, the transition from the upward flow in line with the longitudinal axis of the dirty air conduit 110 to the flow of air out of the mouth 138 of the exhaust duct 112 is facilitated by the present invention. As discussed above, the shoulder 134 receives the end of the dirty air conduit 110 and provides a smooth transition for the airflow for the transition from the dirty air conduit 110 into the exhaust duct 112.

The transition of airflow from vertical to horizontal flow (that is, from flow axial to the dirty air conduit 110 to flow at an approximate right angle thereto out the mouth 138 of the exhaust duct 112) is smoothed by the contoured upper and lower curving 196, 198 of the back and front walls 200, 204 of the interior of the exhaust duct 112. This differs from prior art devices in which the transition is not smoothly contoured to facilitate the change in flow direction. The lower curving 198 of the front wall 204 of the exhaust duct 112 also is smoothly continuous to minimize turbulence generation during the transition in flow directions.

In the present embodiment, the mouth 138 of the exhaust duct 112 has a generally oval cross-sectional shape, which is different from the generally circular cross section of the lower end 122 of the exhaust duct 112. To avoid generation of turbulence, the transition from one shape to the other is likewise smoothly contoured, unlike prior art devices that change abruptly or with sharp edges from one shape to another.

In order to prevent the airstream from impinging directly on the surface of the vacuum cleaner bag opposite to the mouth 138 of the exhaust duct, a deflector 206 may be provided at the upper periphery of the mouth 138 of the exhaust duct 112. The deflector may be attached to the mouth 138 of the exhaust duct 112 by any of a variety of known means, such as being formed integrally with the exhaust duct 112, being welded at the mouth 138 of the exhaust duct 112 or being attached with fasteners such as screws. Again, the deflector 206 is smoothly contoured to avoid generation of excessive turbulence.

In the present embodiment, the upper curving 196 extends from the rear interior wall portion 200 to a position 202 which is generally directly above the front wall portion 204. Thus, a heavy object such as a coin entrained in the airstream of the dirty air conduit 110 is most likely to strike the upper curving wall section 196 of the exhaust duct 112, which is in line with the airstream rising up the lower section of the exhaust duct 112, and be deflected at least partially toward the mouth 138 of the exhaust duct 112. Rebounding of such an object, as in prior art devices, and particularly multiple rebounding, of such objects is particularly unlikely.

In another embodiment, the transition from the generally round cross-sectional shape of the bottom 122 of the exhaust duct 112 to the generally oval cross-sectional shape of the mouth 138 is accomplished while maintaining equal cross-sectional area in planes perpendicular to a curve running through the center of the exhaust duct 112. As will be apparent to those skilled in the art, maintaining such a uniform cross-sectional area reduces velocity changes in the airstream which may also contribute to turbulence and noise.

In another embodiment, the cross-sectional shapes of the lower portion 122 and mouth 138 of the exhaust duct may have the same shape. For example, both could be round or oval. In such case, the interior of the exhaust duct 112 should still be configured such that the interior walls are smoothly contoured to avoid generation of turbulence.

The dirty air exhaust duct 112 and associated components 156, 170, 172 of the present embodiment may be made of a thermoplastic or thermosetting material or other suitable material by one or more known processes such as injection molding, casting, machining and the like, but preferably is made by injection molding of a thermoplastic material. Even more preferably, the material should be of sufficient rigidity and strength to permit the exhaust duct 112 to function as a component of the handle 103 of the vacuum cleaner 110.

The exhaust duct 112 may be formed in two halves, as illustrated in FIG. 4, and these halves may be joined by any of a variety of known methods, such as the use of vibratory welding, thermal bonding, or solvent or adhesive bonding, or by the use of fasteners, such as screws.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with prior art methods to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein of the invention can be applied to other structures. In general, in the following claims, the terms used should not be construed to limit the invention to the specific embodiments disclosed in the specification. Accordingly, the invention is not limited by the foregoing disclosure, but instead its scope is to be determined by the following claims.

What is claimed is:

1. An exhaust duct for a vacuum cleaner for directing a particle-laden airstream from a first direction of travel to a second direction of travel comprising:

a first section adapted to transmit an airstream in a first direction and having a first cross-sectional shape;

a second section adapted to transmit an airstream in a second direction and having a second cross-sectional shape;

a transition section connecting said first and second sections in a generally smoothly continuous manner; and wherein the cross-sectional area of the exhaust duct remains constant along said first, second and transitional sections.

2. The exhaust duct of claim 1 wherein said first and second directions are generally normal to one another.

3. The exhaust duct of claim 2 wherein said second section forms a mouth for transmitting an airstream into the vacuum cleaner bag of the vacuum cleaner.

4. The exhaust duct of claim 3 wherein the transitional section includes an inner wall, and wherein a major portion of the wall of the transitional section in line with the airstream is curved toward said second section.

5. The exhaust duct of claim 1 further comprising a deflector mounted across a portion of the end of said second section for partially deflecting an airstream traveling through said second section.

6. The exhaust duct of claim 1 wherein said second section forms a mouth for transmitting an airstream into the vacuum cleaner bag of the vacuum cleaner.

7. The exhaust duct of claim 1 wherein the cross-sectional shapes of said first and second sections are the same.

8. The exhaust duct of claim 1 wherein the cross-sectional shape of said first section is generally circular and wherein the cross-sectional shape of said second section is generally oval.

9. An upright vacuum cleaner comprising:

a head containing an air inlet, a fan, an electric motor, an exhaust conduit and a source of electrical power for said motor;

an elongated handle mounted to the head for controlling and maneuvering the head and having a grip at its distal end;

a mouth for exhausting air into a vacuum cleaner bag said vacuum cleaner bag being mountable to said mouth such that said mouth is in communication with the interior of the vacuum cleaner bag; and a conduit connected to the exhaust conduit of the head adapted to transmit an airstream from the exhaust conduit to the mouth, said conduit comprising:

a first section adapted to transmit an airstream generally in a first direction from a position proximate to said head to a position proximate said mouth, said first section having a first cross-sectional shape, a second section adapted to receive an airstream and transmit it in a second direction to the mouth, said second section having a second cross-sectional shape, and a third, transitional section connecting said first and second sections and having a smoothly contoured interior adapted to transmit an airstream from said first section to said second section;

wherein the cross-sectional area of the conduit remains constant along said first, second and transitional sections.

10. The vacuum cleaner of claim 9 wherein said first and second directions are generally normal to one another.

11. The vacuum cleaner of claim 10 wherein the transitional section includes an inner wall, and wherein the major portion of the wall of the transitional section in line with an airstream transmitted by said first section is curved toward said second section.

12. The vacuum cleaner of claim 9 further comprising a deflector mounted across a portion of the mouth for partially deflecting an airstream traveling through said mouth.

13. The vacuum cleaner of claim 9 wherein the cross-sectional shape of said first section is generally circular and wherein the cross-sectional shape of said second section is generally oval.

* * * * *